United States Patent [19]

Sekozawa et al.

[11] Patent Number: 4,897,791

[45] Date of Patent: Jan. 30, 1990

[54] ASYNCHRONOUS FUEL INJECTION METHOD

[75] Inventors: Teruji Sekozawa, Kawasaki; Makoto Shioya, Tokyo; Motohisa Funabashi, Sagamihara, all of Japan

[73] Assignee: Hitachi, Ltd., Tokyo, Japan

[21] Appl. No.: 897,430

[22] Filed: Aug. 18, 1986

[30] Foreign Application Priority Data

Sep. 4, 1985 [JP] Japan ..... 60-193736

[51] Int. Cl.[4] ..... F02B 3/00; F02B 3/08

[52] U.S. Cl. ..... 364/431.05; 123/492; 123/493; 364/431.07

[58] Field of Search ..... 364/431.05, 431.07; 123/492, 493

[56] References Cited

U.S. PATENT DOCUMENTS

| | | | |
|---|---|---|---|
| 4,437,303 | 3/1984 | Cantwell | 60/39.281 |
| 4,527,529 | 7/1985 | Suzuki et al. | 123/492 |
| 4,590,564 | 5/1986 | Ishikawa et al. | 123/492 X |
| 4,616,619 | 10/1986 | Saito et al. | 123/492 X |
| 4,677,560 | 6/1987 | Cao et al. | 364/431.07 |
| 4,685,436 | 8/1987 | Oba | 123/492 |
| 4,729,362 | 3/1988 | Mori | 123/492 |

OTHER PUBLICATIONS

"Transient A/F Control Characteristics of the 5 Liter Central Fuel Injection Engine" by C. F. Aquino, Society of Automotive Engineers Technical Paper 810494.

*Primary Examiner*—Parshotam S. Lall
*Assistant Examiner*—V. N. Trans
*Attorney, Agent, or Firm*—Antonelli, Terry & Wands

[57] ABSTRACT

An asynchronous fuel injection control method for engines where the amount of increase of air sucked into the cylinder of the engine corresponding to the variation of the throttle angle is estimated on the basis of a physical model formula expressing the amount of the sucked air in the cylinder, and a pulse width according to which the fuel is injected by the asynchronous injection into the engine is determined on the basis of the estimated amount of increase of the sucked air.

2 Claims, 2 Drawing Sheets

ASYNCHRONOUS FUEL INJECTION METHOD

BACKGROUND OF THE INVENTION

The present invention relates to a fuel injection control method for an engine and more particularly to an asynchronous fuel injection method suitable for determining the amount of asynchronous fuel injection (or an asynchronous injection) required for transient fuel compensation during rapid acceleration of the engine.

The conventional asynchronous fuel injection method injects an amount of fuel meeting the variation of the quantity of air when the throttle valve is suddenly opened so that a predetermined quantity of fuel corresponding to the variation of the throttle angle is injected. To be sure, this attempts to compensate for the variation of air quantity which, due to a delay in the detection of air quantity by an air quantity sensor, is unable to follow the fixation of the air-fuel ratio at rapid acceleration of the engine through the variation of the throttle angle as predicting information. However, the variation of air quantity at rapid engine acceleration is considered to be affected not only by the varying throttle angle but also by the intake manifold pressure, atmospheric pressure and sucked air temperature whereas the conventional method has not been controlled in consideration of these factors.

SUMMARY OF THE INVENTION

The object of the present invention is to provide an asynchronous fuel injection method for compensating the shortage of fuel with respect to its required quantity when the fuel is injected only in synchronism with the crank angle, by accurately predicting the variation of air quantity on the basis of a physical model formula for the air quantity entering the throttle body.

There is a method for determining the amount of asynchronous fuel injection according to the variation of the throttle angle. However, even if the torque hesitation is prevented by this method, there will take place a rich spike in the air-fuel ratio. However, if an attempt is made to prevent such a spike, the torque hesitation will take place. To overcome the above disadvantages, the present invention seeks to derive the degree of variation of air quantity from a physical model formula. As sensor information data required for calculating the variation of air quantity from the physical model formula, the intake manifold pressure, atmospheric pressure and temperature of the air entering the throttle body as well as the throttle angle may be used so that the variation of air quantity is minutely estimated and from this estimated variation, the amount of interrupt fuel injection capable of preventing the spike in the air-fuel ratio and torque hesitation are determined.

DETAILED DESCRIPTION OF PREFERRED EMBODIMENTS

One embodiment of the present invention will be described with reference to the drawings.

Figure 1:
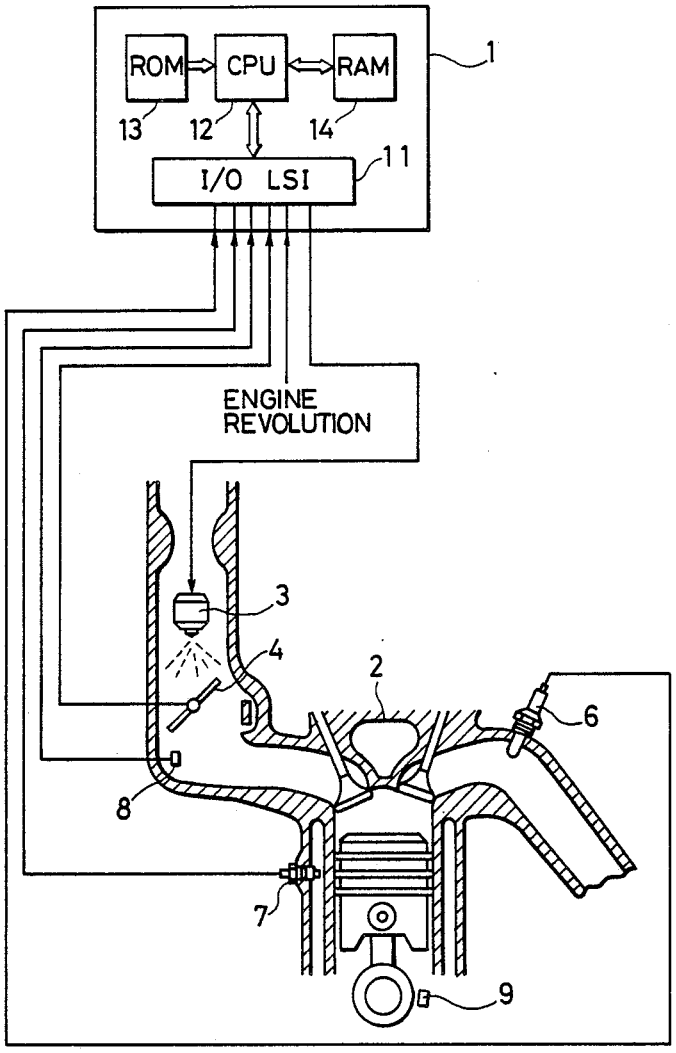
FIG. 1 is a view showing a structure of the D-jetronics system of single point injection.

Referring to FIG. 1 which is a diagram showing an engine system using a single injector, air flows from upper part of an injector 3, passes through a throttle valve 4 for adjusting the quantity of air and is sucked into the cylinder of an internal combustion engine 2 while, at the same time, fuel is supplied into an intake manifold from the injector 3. A control unit 1 stores through an I/O LSI (Input/Output Large Scale Integration Circuit) 11 the valve position of a throttle valve 4, the quantity of oxygen in the exhaust gases detected by an $O_2$ sensor 6, the cooling water temperature detected by a water temperature sensor 7, the intake manifold pressure detected by a pressure sensor 8, and the engine r.p.m. detected through a crank angle sensor 9 as information from the engine sensors, and a calculating procedure based on an appointed model formula in a ROM (Read Only Memory) 13 is performed in a CPU (Central Processing Unit) 12 by using a RAM (Random Access Memory) 14 so that an asynchronous fuel injection pulse width is calculated and a pulse signal is transmitted to the injector 3 through the I/O LSI 11. To make sure the fluctuation of the quantity of sucked air, the following model is used. The quantity of air Ma sucked into the cylinder by the reciprocating motions of the piston can be expressed by the following formulae on the bases of the throttle angle, intake manifold pressure, atmospheric pressure and temperature of the air entering the throttle body:

$$M_a = \frac{C_d A P_b (2K)}{R(K-1)\sqrt{T_a}} \sqrt{\left(\frac{P}{P_b}\right)^{\frac{2}{K}} - \left(\frac{P}{P_b}\right)^{\frac{K+1}{K}}} \quad (1)$$

(For example, the above formula is described in the Society of Automotive Engineers Technical Paper Series 810499.)

wherein $C_d$: Discharge coefficient of throttle $P_b$: Atmospheric pressure $T_a$: Temperature of the air entering the throttle body K: Ratio of specific heats of air P: Intake manifold pressure R: Ideal gas constant for air A: Throttle flow area $$A = a + b(1 - \cos\theta) \quad (2)$$

wherein:

$\theta$ is a throttle angle, a: Flow area when the throttle valve is fully closed.

b: Area of throttle valve.

When the engine is in the normal operating condition (which is defined herein as a time at which the variables in the formulae (1) and (2), such as the throttle angle and the intake manifold pressure are constant), the quantity of sucked air Ma can be obtained from the formulae (1) and (2) and by injecting a quantity of fuel corresponding to the Ma, a target air-fuel ratio is attained. To estimate the quantity of air when the throttle valve is opened rapidly, since the throttle angle $\theta$ is basically determined by the driver, the variation of the throttle angle becomes important predicting information datum in the fuel supply system for estimating the quantity of air. However, the throttle angle is not always determined by the quantity of sucked air in the manner shown by the formulae (1) and (2). Further, it is also possible to re-obtain the the quantity of sucked air by using the formulae (1) and (2) when the throttle valve is opened and the qualtity of sucked air is varying, and to perform an asynchronous injection of fuel corresponding to the amount of shortage of fuel due to an increase in the quantity of sucked air. However, in view of the nature of asynchronous fuel injection by which the fuel to fill the shortage is injected in asynchronism with the crank angle, it is necessary to perform such asynchronous injection quickly whenever so required and further, in case the quantity of sucked air is re-obtained from the formulae (1) and (2), it takes too much time for the CPU 12 to calculate the formulae so that the injection timing is lost and the amount of exhaust gases also increases.

In the embodiment of the present invention, it is possible to perform an asynchronous fuel injection by accurately estimating the amount of increase of air. According to the present embodiment, it is possible to determine the quantity of asynchronous fuel injection more accurately than determining that on the basis of information on the throttle angle only.

Basically, the asynchronous fuel injection is performed in the following manner: To begin with, assume that the calculating period is ΔT and there are no changes in the intake manifold pressure, the atmospheric pressure and the temperature of the air entering the throttle body when the throttle valve is opened during the period ΔT. In this case, if then, $$E = \frac{C_b P_b (2K)}{R(K-1)\sqrt{T_a}} \sqrt{\left(\frac{P}{P_b}\right)^{\frac{2}{K}} - \left(\frac{P}{P_b}\right)^{\frac{K+1}{K}}} \quad (3)$$

the formulae (1) and (2) may be converted to the following formula with E designating the quantity of air per unit throttle area.

$$M_a = E[a + b(1 - \cos\theta)] \quad (4)$$

From the above formula, the amount of increase of air intake during the above-mentioned time ΔT between a time k−1 and a time k may be expressed by the following formula:

$$M_a(k) - M_a(k-1) = E(k-1) \cdot b[\cos\theta(k-1) - \cos\theta(k)] \quad (5)$$

wherein E (k−1) will be replaced with E (k) when the amount of synchronous fuel injection is calculated at the time k.

As expressed by the formula (5), the amount of increase of air can be calculated by the variation of the throttle angle expressed by "cos θ (k−1)−cos θ (k)" and the existing data E (k−1). Thus, after having estimated the amount of increase of sucked air, an asynchronous injection pulse width $T_{IS}$ is determined by the following formula:

$$T_{IS}(k) = K_I \frac{E(k-1)b[\cos\theta(k-1) - \cos\theta(k)]}{N(k)} \quad (6)$$

wherein:

$K_I$: Coefficient determined by the characteristics of the injector

N: Engine r.p.m.

The foregoing is a description of the D-jetronics system attached with a pressure sensor for measuring the intake manifold pressure, instead of an air quantity sensor (e.g., a hot wire sensor) for measuring the amount of air. Next, the L-jetronics system using the sucked air sensor 5 shown in FIG. 2 will be described.

Figure 2:
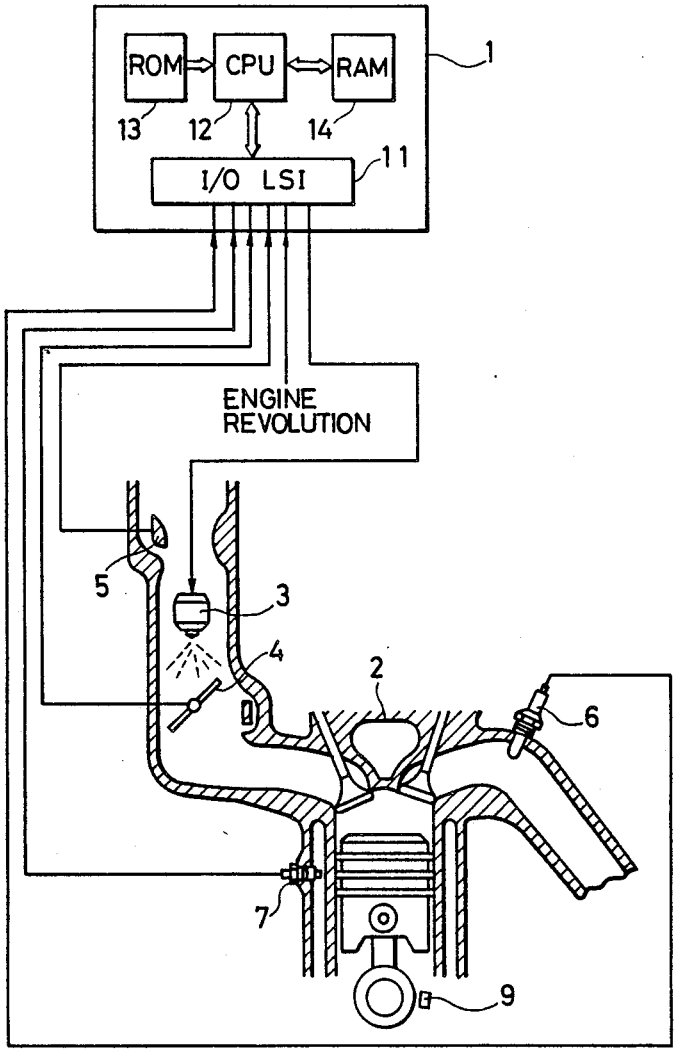
FIG. 2 is a view showing a structure of the L-jetronics system of single point injection.

The difference between the structure of the device shown in FIG. 1 and that shown in FIG. 2 is that in the case of the latter, a hot wire air mass meter 5 for detecting the quantity of sucked air instead of a pressure sensor 8 for detecting the intake manifold pressure is arranged at the inlet of the air intake manifold.

As described with reference to the D-jetronics system, the formula (3) is defined to obtain the formulae (4) and (5) and in this case, E (k−1) in the formula (5) can be obtained by the following formula on the basis of the formula (4).

$$E(k-1) = \frac{M_a(k-1)}{a + b[1 - \cos\theta(k-1)]} \quad (7)$$

Further, the formula (6) for obtaining the interrupt injection pulse width $T_{IS}$ develops as follows from the formula (7).

$$\begin{aligned} T_{IS}(k) &= K_I \frac{E(k-1)b[\cos\theta(k-1) - \cos\theta(k)]}{N(k)} \\ &= K_I \frac{M_a(k-1) \cdot b[\cos\theta(k-1) - \cos\theta(k)]}{N(k) \cdot [a + b\{1 - \cos\theta(k-1)\}]} \end{aligned} \quad (8)$$

wherein in the right side of the formula (8), that is, $$K_I \frac{M_a(k-1)}{N(k)}$$

the engine r.p.m. does not almost change during the T time, so that the formula:

$$N(k) = N(k-1) \quad (9)$$

is established and hence, $$T_P(k-1) = K_I \frac{M_a(k-1)}{N(k-1)} \quad (10)$$

In other words, the right side of the formula (10) is a basic injection pulse width which has already been calculated at the time (k−1). Accordingly, the injection pulse width according to the formula (8) can be expressed by the following formula:

$$T_{IS}(k) = T_P(k-1) \cdot \frac{b[\cos\theta(k-1) - \cos\theta(k)]}{a + b[1 - \cos\theta(k-1)]} \quad (11)$$

What is meant by the formula (11) is that the asynchronous injection pulse width can be obtained by the already calculated basic injection pulse width and the throttle angle.

The method according to the present embodiment, in which the quantity of the fuel meeting an increase in the quantity of sucked air at the time of opening the throttle valve is calculated on the basis of an asynchronous injection pulse width, has advantages in that since the quantity of interrupt injection fuel is calculated accurately and in a simple manner, the phenomena such as a spike in the air-fuel ratio and a torque hesitation are prevented. Further, since the embodiment makes use of already calculated data effectively, the calculation time required for performing an interrupt fuel injection can be minimized.

According to the present invention, it is possible to inject by the asynchronous injection a quality of fuel corresponding to the variation of the quantity of air when the throttle valve is opened at rapid acceleration of the engine, so that the torque hesitation at that time is prevented resulting in improving the acceleration characteristics of the engine and the increase of exhaust gasses due to a lean spike or rich spike in the air-fuel ratio is controlled. Further, the present invention can be used for both D-jetronics and L-jetronics systems and is applicable to the ordinary fuel injection control.

What is claimed is:

1. A method of controlling an amount of fuel injection in accordance with information from a sensor within an engine, wherein an asynchronous fuel injection pulse width for injecting fuel in asynchronism with a crank angle is determined by a calculation periodically performed in asynchronism with the crank angle, said method comprising the steps of:

calculating an amount of increase of a throttle flow area during a period between a time k−1 and a time k in accordance with throttle angles at the time k−1 and k; and determining the asynchronous fuel injection pulse width at the time k on the basis of the calculated amount of increase of the throttle flow area;

wherein the asynchronous fuel injection pulse width $T_{IS}(k)$ at the time k is determined by the following expression $$T_{IS}(k) = K_I \cdot \frac{E(k-1)b[\cos\theta(k-1) - \cos\theta(k)]}{N(k)},$$

where:

$K_I$ is a coefficient determined by characteristics of an injector,

N(k) is an engine r.p.m. at the time k,

E(k−1) is a quantity of air per unit throttle area, calculated at the time k−1, b is an area of throttle valve, $\theta$ (k−1) is a throttle angle at the time k−1, and $\theta$ (k) is a throttle angle at the time k.

2. A method of controlling an amount of fuel injection in according with information from a sensor within an engine, wherein an asynchronous fuel injection pulse width for injecting fuel in asynchronism with a crank angle is determined by calculation periodically performed in asynchronism with the crank angle, said method comprising the steps of:

calculating a throttle flow area at a time k−1 in accordance with a throttle angle at the time k−1;

calculating an amount of increase of the throttle flow area during a period between the time k−1 and a time k in accordance with throttle angles at the time k−1 and the time k; and determining the asynchronous fuel injection pulse width at the time k on the basis of the calculated amount of increase of the throttle flow area and the calculated throttle flow area;

wherein the asynchronous fuel injection pulse width $T_{IS}$ at the time k is determined by the following expression:

$$T_{IS}(k) = T_P(k-1) \cdot \frac{b[\cos\theta(k-1) - \cos\theta(k)]}{a + b[1 - \cos\theta(k-1)]}$$

where:

$T_P$(k−1) is a basic injection pulse width calculated at the tim k−1, a is a flow area when a throttle valve is fully closed, b is an area of the throttle valve, $\theta$ (k−1) is a throttle angle at the time k−1, and $\theta$ (k) is a throttle angle at the time k.

* * * * *